US007690753B2

(12) United States Patent
Sakurai

(10) Patent No.: US 7,690,753 B2
(45) Date of Patent: Apr. 6, 2010

(54) RECORDING APPARATUS AND MAINTENANCE METHOD FOR RECORDING APPARATUS

(75) Inventor: Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 216 days.

(21) Appl. No.: 12/001,904

(22) Filed: Dec. 13, 2007

(65) Prior Publication Data

US 2008/0143763 A1 Jun. 19, 2008

(30) Foreign Application Priority Data

Dec. 14, 2006 (JP) ..... 2006-337162

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS

2002/0101468 A1* 8/2002 Roman et al. ..... 347/19
2004/0212666 A1* 10/2004 Hoen et al. ..... 347/92
2005/0122380 A1 6/2005 Nakamura et al.
2006/0001707 A1 1/2006 Ito et al.

FOREIGN PATENT DOCUMENTS

JP 2005-178240 7/2005
JP 2006-44236 2/2006

* cited by examiner

*Primary Examiner*—Matthew Luu
*Assistant Examiner*—Justin Seo
(74) *Attorney, Agent, or Firm*—Eugene Ledonne; Joseph W. Treloar; Frommer Lawrence & Haug

(57) ABSTRACT

An ink which is supplied from an ink cartridge via an ink supply tube is stored in an ink tank, and is supplied to a recording head. The ink cartridge is detachably connected to the ink supply tube. At every predetermined time interval, a maintenance unit carries out an air discharge operation to discharge air accumulated in the ink tank, through an air discharge passage. Moreover, even at a time shorter than the predetermined time interval, when a frequency of replacement of the ink cartridge is higher than a predetermined value, the air discharge operation is carried out and the air accumulated in the ink tank is discharged.

14 Claims, 5 Drawing Sheets

RECORDING APPARATUS AND MAINTENANCE METHOD FOR RECORDING APPARATUS

CROSS-REFERENCE TO RELATED APPLICATION

The present application claims priority from Japanese Patent Application No. 2006-337162, filed on Dec. 14, 2006, the disclosure of which is incorporated herein by reference in its entirety.

BACKGROUND OF THE INVENTION

1. Field of the Invention

The present invention relates to a recording apparatus which includes a recording head to which an ink is supplied from a detachable ink cartridge, and a maintenance method for the recording apparatus.

2. Description of the Related Art

In a recording apparatus described in Japanese Patent Application Laid-open No. 2005-178240 (FIG. 1 and FIG. 3), an ink-jet recording head is mounted on a carriage, and the recording is carried out by jetting an ink onto a recording medium, while moving with respect to the recording medium. The ink is supplied from an ink cartridge which is stationary in a main body of the recording apparatus to the recording head which moves, via an ink supply tube which is flexible.

In many cases, a tube made of a resin material is used for imparting flexibility to the ink supply tube, and a shielding property with respect to air is not perfect. Therefore, a phenomenon in which air enters into the ink by a small amount arises. This air becomes an air bubble and blocks a channel inside the recording head, thereby causing a jetting defect.

Consequently, in the recording apparatus described in Japanese Patent Application Laid-open No. 2005-178240, the ink is not supplied directly to the recording head from the ink supply tube, but the ink passed through the ink supply tube is supplied to the recording head after storing once in an ink storage section (corresponds to a damper unit 13 in Japanese Patent Application Laid-open No. 2005-178240). Moreover, air is trapped in the ink storage section, and the trapped air is discharged at a predetermined time interval by operating an air discharge valve mechanism which is attached to the ink storage section.

On the other hand, the ink cartridge, as it has been described in Japanese Patent Application Laid-open No. 2006-44236, is detachably mounted together with a case, on an accommodating section (corresponds to an ink storage section 15 in Japanese Patent Application Laid-open No. 2006-44236) of the recording apparatus. An ink receiving section in the form of a thin hollow shaft communicating with the ink supply tube is protruded, from the accommodating section. Moreover, the ink cartridge is mounted on the accommodating section by inserting the ink receiving section into an ink outflow hole of the ink cartridge. The ink infused into the ink receiving section from the ink cartridge is supplied to the recording head via the ink supply tube.

In a case of a replaceable ink cartridge, it is not possible to perfectly avoid air from entering into the ink to some extent through an engagement portion of the ink receiving section described above and the ink outflow hole, at the time of attaching or detaching the ink cartridge. The air mixed in the ink from a detachable portion of the ink cartridge, or from a tube wall of the ink supply tube is stored in the ink storage section, and can be discharged periodically by the air discharge operation as described in Japanese Patent Application Laid-open No. 2005-178240.

However, in a case of a heavy user, a substantial amount of ink might be consumed, and the ink cartridge might be replaced very frequently. Further, the ink cartridge might be attached and detached repeatedly for checking the recording apparatus. In such a case, a substantial amount of air beyond expectation is accumulated in the ink storage section, and the discharge of the air by the periodic discharge operation is not sufficient, which causes a jetting defect of the recording head.

SUMMARY OF THE INVENTION

The present invention has been made to solve the above-mentioned problems, and an object of the present invention is a realization of a recording apparatus which is capable of preventing the jetting defect of the recording head by discharging appropriately the air which has accumulated in the ink storage section, even when a substantial amount of air is accumulated in the ink storage section due to frequent attaching and detaching of the ink cartridge, and a maintenance method for the recording apparatus.

According to a first aspect of the present invention, there is provided a recording apparatus which records an image on a recording medium with an ink, the recording apparatus including: an ink cartridge which is detachably fixed to the recording apparatus and stores the ink; a recording head which records the image by jetting the ink stored in the ink cartridge onto the recording medium; an ink tank which stores the ink supplied from the ink cartridge and which supplies the ink to the recording head; an air discharge mechanism which discharges air accumulated in the ink tank; a controller which controls the air discharge mechanism to discharge the air accumulated in the ink tank at a predetermined time interval; and a counter which counts attachment-detachment number of times of the ink cartridge performed after the air discharge mechanism previously discharged the air accumulated in the ink tank, wherein if the attachment-detachment number of times counted by the counter is not less than a predetermined value in the predetermined time interval, the controller controls the air discharge mechanism to discharge the air accumulated in the ink tank.

According to the first aspect of the present invention, normally the discharge operation is carried out at every predetermined time interval. However, in the predetermined time interval, when the attachment-detachment number of times of the ink cartridge stored in the counter has surpassed a predetermined value, the air is discharged from the ink tank. In other words, during the predetermined time interval, when the attachment-detachment number of times of the ink cartridge is extremely high, the periodic air discharge operation is not sufficient, and a substantial amount of air more than expected is accumulated in the ink tank. By discharging the air not only periodically but also based on the attachment-detachment number of times of the ink cartridge, it is possible to discharge the air accumulated in the ink tank appropriately, and to maintain a jetting condition of the recording head to be favorable. Hereinafter, the "attachment-detachment number of times of the ink cartridge" means total of the number of times for which the ink cartridge is attached to the apparatus and the number of times for which the ink cartridge is detached from the apparatus.

The recording apparatus of the present invention, may further include an ink supply tube which connects the ink cartridge and the ink tank, wherein the ink may be supplied from the ink cartridge to the ink tank, via the ink supply tube.

The recording apparatus of the present invention may further include an ink cartridge detector which detects that the ink cartridge is detached from and attached to the recording apparatus. In this case, the recording apparatus is capable of detecting that the ink cartridge has been detached from and attached to the recording apparatus.

In the recording apparatus of the present invention, the counter may store the attachment-detachment number of times; and the controller may increment the attachment-detachment number of times stored in the counter when the ink cartridge detector detects that the ink cartridge has been detached from the recording apparatus and when the ink cartridge detector detects that the ink cartridge has been attached to the recording apparatus. In this case, the recording apparatus is capable of storing the number of times of detaching and attaching the ink cartridge.

The recording apparatus of the present invention may further include a cap, and the air discharge mechanism may include an air discharge passage having one end which is connected to the ink tank and having the other end which is covered by the cap, an air discharge valve which is provided on the air discharge passage, a valve opening and closing mechanism which opens and closes the air discharge valve, and a pump which sucks the air accumulated in the ink tank via the cap and the air discharge passage. In this case, by opening the air discharge valve by the valve opening and closing mechanism, and sucking the air accumulated in the ink tank by the pump via the cap and the air discharge passage, it is possible to discharge the air accumulated in the ink tank outside.

In the recording apparatus of the present invention, the one end of the air discharge passage may protrude from an inner surface of the ink tank toward an inner side of the ink tank. In this case, when the air is discharged, the air inside the ink tank is sucked, and due to blocking of one end of the air discharge passage by the ink, the air is remained at one end of the air discharge passage. This air acts as a damper which absorbs a pressure fluctuation generated in the ink inside the ink tank at the time of recording operation, and an adverse effect on the recording head is reduced.

In the recording apparatus of the present invention, an air discharge port having a diameter smaller than an inner diameter of the air discharge passage may be formed in the air discharge passage at an intermediate portion thereof; and the air discharge valve may be biased in a bias direction to close the air discharge port by an elastic body. By making such an arrangement, it is possible to maintain a state in which the air discharge port is normally blocked by the valve.

In the recording apparatus of the present invention, the air discharge valve may include a rod which extends in the bias direction; and the valve opening and closing mechanism may open the air discharge valve by moving the rod in a direction opposite to the bias direction. In this case, by moving the valve opening and closing mechanism, it is possible to open the air discharge port which is normally blocked by the air discharge valve.

In the recording apparatus of the present invention, the controller may further include a timer which measures a time during which the ink cartridge has been detached from the recording apparatus; and when the time measured by the timer surpasses a predetermined time, the controller may increment the attachment-detachment number of times stored in the counter. In this case, it is possible to use the time during which the ink cartridge had been removed from the recording apparatus, as a condition for discharging the air.

The recording apparatus of the present invention may further include a carriage which is movable with respect to a body of the recording apparatus, and the recording head and the ink tank may be provided on the carriage; and after the air discharge mechanism has discharged the air accumulated in the ink tank, a predetermined amount of air may remain in the ink tank. In this case, since the remained air acts as the damper which absorbs the pressure fluctuation generated in the ink inside the ink tank at the time of recording operation, it is possible to maintain the jetting condition of the recording head to be favorable.

The recording apparatus of the present invention may further include a carriage which is movable with respect to a body of the recording apparatus, and the recording head and the ink tank may be provided to the carriage; and the ink supply tube may be flexible. In this case, since the ink supply tube is flexible, even when the ink tank moves with respect to the body of the recording apparatus, the ink supply tube is capable of following the movement of the ink tank.

According to a second aspect of the present invention, there is provided a maintenance method for a recording apparatus including an ink cartridge which stores an ink and which is detachably fixed to the apparatus, a recording head which jets the ink stored in the ink cartridge, and an ink tank which stores the ink supplied from the ink cartridge and supplies the ink to the recording head, the method comprising: discharging air accumulated in the ink tank; measuring an elapsed time elapsed after the air has been discharged; storing attachment-detachment number of times of the ink cartridge from and to the recording apparatus performed after the air accumulated in the ink tank has been discharged; detecting the elapsed time elapsed after the air has been discharged; comparing the elapsed time with a predetermined time; detecting the attachment-detachment number of times stored in the counter, if the elapsed time is not more than the predetermined time; comparing the detected attachment-detachment number of times with a predetermined value; and discharging air accumulated in the ink tank when the detected attachment-detachment number of times is not less than the predetermined value.

According to the second aspect of the present invention, even if the predetermined time is not elapsed after the air has previously discharged, if the attachment-detachment number of times of the ink cartridge is higher than the predetermined value, the air in the ink tank is discharged. Therefore, it is possible to discharge appropriately the air accumulated in the ink tank, and to maintain the jetting condition of the recording head to be favorable.

In the maintenance method for the recording apparatus of the present invention, when an instruction for a recording operation is given to the recording apparatus, the elapsed time may be detected, or when the recording apparatus is switched on, the elapsed time may be detected.

DETAILED DESCRIPTION OF THE PREFERRED EMBODIMENTS

Figure 1:
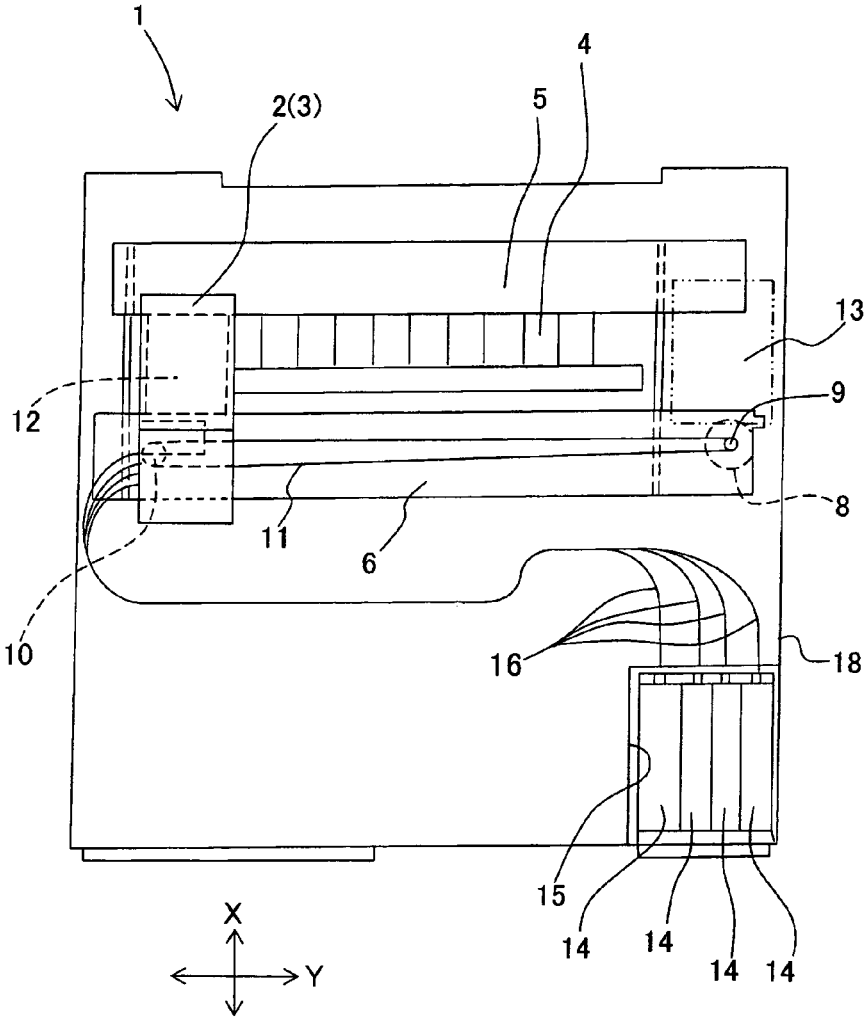
FIG. 1 is a schematic plan view of a recording apparatus of an embodiment of the present invention.

A basic embodiment of the present invention will be described below by referring to the accompanying diagrams. FIG. 1 is a schematic plan view of a recording apparatus 1 of the embodiment.

Figure 2:
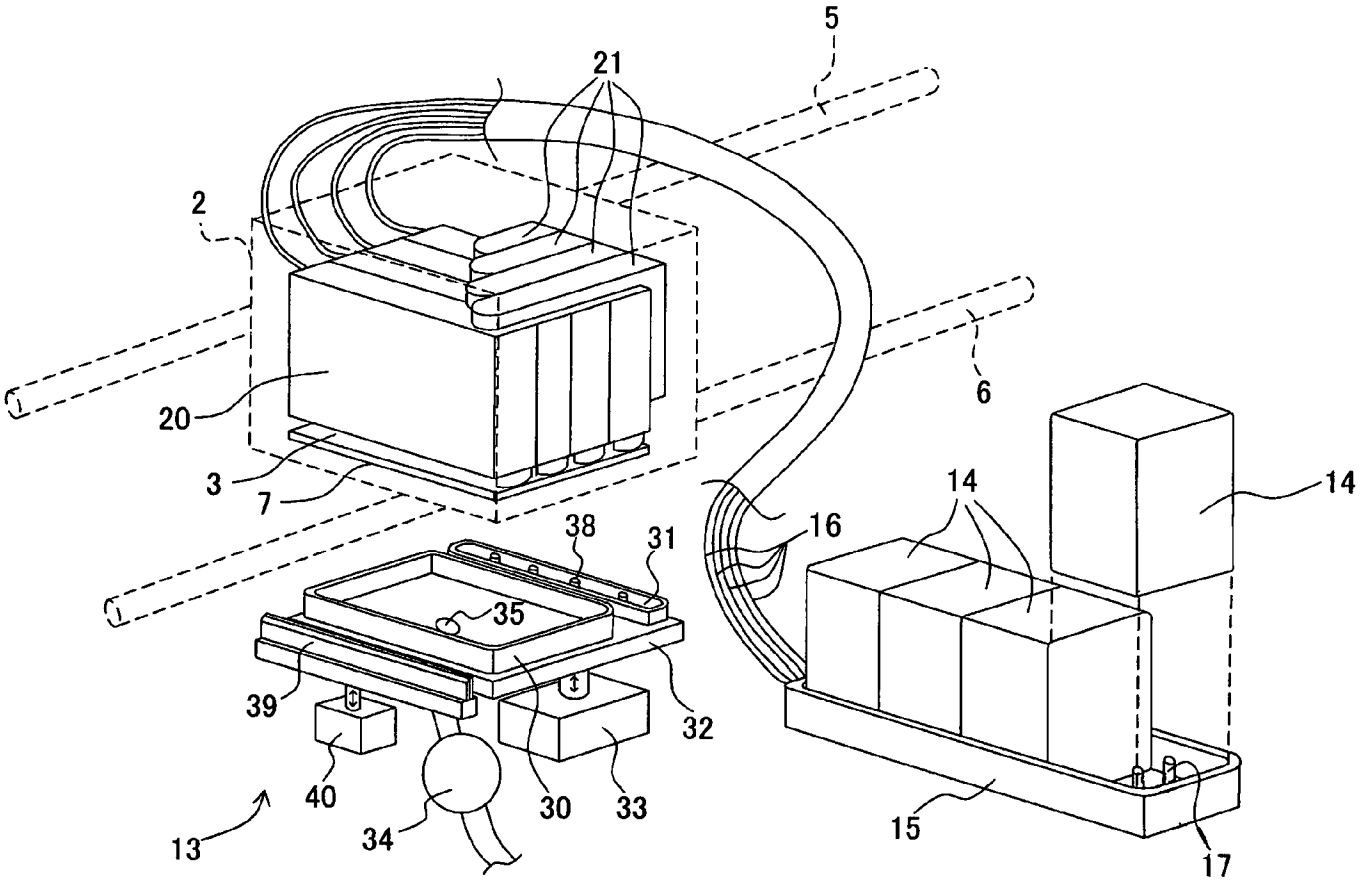
FIG. 2 is a schematic perspective view showing a maintenance unit and a surrounding of a recording head.

The recording apparatus 1, as shown in FIG. 1, is provided with a recording head 3 mounted on a carriage 2, and a platen 4 facing a lower surface of the recording head 3. A first guide member 5 and a second guide member 6 are members which extend in a main scanning direction (Y axis direction) of the carriage 2, and the carriage 2 reciprocates along the first guide member 5 and the second guide member 6. The recording head 3 is installed in the carriage 2 such that a nozzle formation surface 7 of the recording head 3 is exposed from an opening provided on a lower surface of the carriage 2, as shown in FIG. 2.

A paper which is a recording medium, is transported along a secondary scanning direction (X axis direction) which is orthogonal to the main scanning direction (Y axis direction). The paper is transported by a plurality of transporting rollers 42 (not shown in FIG. 1, refer to FIG. 4) for paper feeding and for paper discharge. The carriage 2 reciprocates along the Y axis direction by a timing belt 11 which is put around a driven pulley 10 and a drive pulley 9 coupled with a carriage (CR) motor 8.

Inside a body 18 of the recording apparatus 1 (recording apparatus body 18), at one side (left side in FIG. 1) on an outer side of a width of the paper in the Y axis direction (recording region), an ink receiving section 12 is provided, and on the other side thereof (right side in FIG. 1), a maintenance unit 13 is provided. The recording head 3 periodically carries out ink jetting to prevent nozzles from being blocked with viscous ink or the like, during a recording operation, at a position facing the ink receiving section 12 (in other words, a flushing position). The maintenance unit 13 is provided corresponding to a standby position (maintenance position or home position) of the carriage 2, and carries out a recovery operation (purging) for the recording head 3. Details of the recovery operation will be described later.

The recording apparatus body 18, as shown in FIG. 1, is provided with an accommodating section 15 of ink cartridges 14 which are replaceable. In conformity with the number of ink colors, here, four ink cartridges 14 for a black ink, a cyan ink, a magenta ink, and a yellow ink are accommodated in the accommodating section 15. Each of the ink cartridges 14 is fixed to be individually detachable from the accommodating section 15. Ink in each of the ink cartridges 14 is supplied independently to the recording head 3 via one of ink supply tubes (tube made of resin) 16 which are flexible. The ink supply tubes 16 being flexible, are capable of following a reciprocation of the recording head 3 in the main scanning direction.

Ink outflow holes (not shown in the diagram) are provided in each of the ink cartridges 14. On the other hand, ink receiving sections 17 protrude from a bottom surface of the accommodating section 15. Each of the ink receiving sections 17 is in the form of a hollow shaft (might as well be in the form of a hollow needle) and communicates with one of the ink supply tubes 16 as shown in FIG. 2. The ink receiving sections 17 are provided at four locations in conformity with the number of ink cartridges 14, and each of the ink supply tubes 16 communicates with one of the ink receiving sections 17. Consequently, the ink in each of the ink cartridges 14 flows into one of the ink supply tubes 16 by pressing one of the ink cartridges 14 into the accommodating section 15 so that one of the ink receiving section 17 is inserted into the ink outflow hole (not shown in the diagram) of the ink cartridge, and by mounting the ink cartridge 14 in the accommodating section 15.

In the accommodating section 15, ink cartridge detectors 310 (refer to FIG. 4) are arranged for the ink cartridges 14. Each of the ink cartridge detectors 310 detects attaching and detaching of the ink cartridge 14 to and from the ink receiving section 17. The number of times for which each of the ink cartridge detectors 310 has detected the detaching and the attaching of the ink cartridge 14 is stored in a counter 50 which is provided to a controller 300 (refer to FIG. 4). In other words, when each of the ink cartridge detectors 310 detects that the ink cartridge 14 has been detached from and attached to one of the ink receiving sections 17, the controller 300 increments the number of times of detaching and attaching (attachment-detachment number of times) of the ink cartridge 14, which is stored in the counter 50. The number of times of detaching and attaching of the ink cartridge 14 is reset when an air discharge operation which will be described later is carried out, and is started again from zero.

An ink storage section 20 (ink tank) which stores once the ink supplied via the ink supply tubes 16, and supplies the ink to the recording head 3, is mounted on the carriage 2 as shown in FIG. 2. The ink storage section 20 is partitioned into four compartments for storing individually the ink of each color, and is arranged at an upper portion of the recording head 3. In the recording head 3, nozzle rows are provided according to the ink colors, and the ink stored in each of the four compartments is supplied to one of the corresponding nozzle rows. Moreover, air discharge passages 21 each of which corresponds to each of the four compartments of the ink storage section 20 are provided to the ink storage section 20. Each of the air discharge passage 21 is extended from an upper surface to a side surface of the ink storage section 20. One end 21*a* of each of the air discharge passages 21 communicates with an upper side of an inner portion of the corresponding compartment of the ink storage section 20, and the other end 21*b* of each of the air discharge passage 21 is opened at a position at a substantially same height of the nozzle formation surface 7 of the recording head 3.

Figure 3:
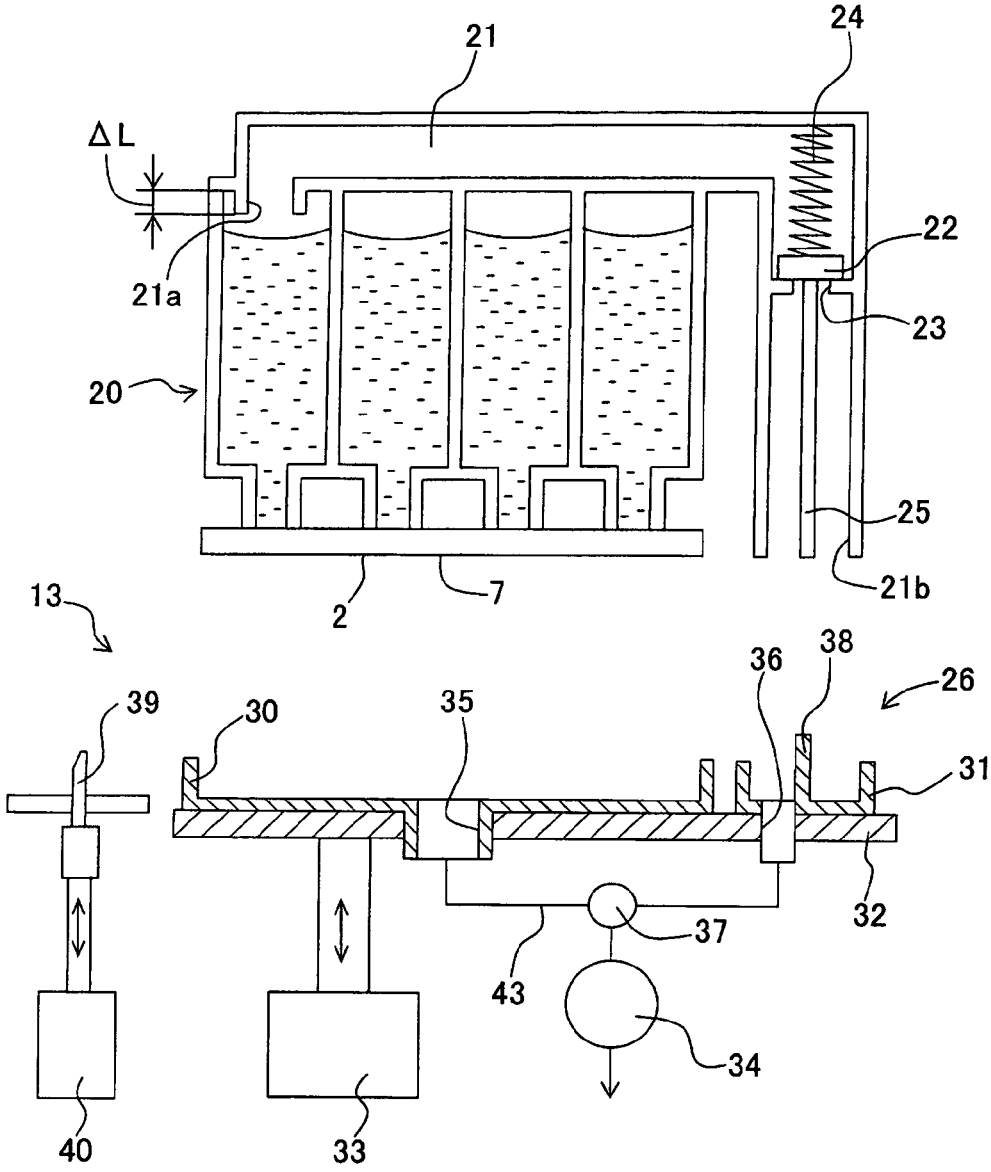
FIG. 3 is a schematic cross-sectional view showing the maintenance unit and the surrounding of the recording head.

As shown in FIG. 3, the one end 21*a* of each of the air discharge passages 21 is formed to protrude downward only by $\Delta L$ from a ceiling surface thereof toward the inner side of the ink storage section 20. Accordingly, in each of the air discharge passages 21, air of a volume (predetermined amount) equivalent to a height $\Delta L$ downward from the ceiling surface of the storage section 20 outside is not discharged outside from the air discharge passage 21 even when an air discharge operation which will be described later is carried out, and remains assuredly inside the ink storage section 20. This air is used as a damper which absorbs a pressure fluctuation of ink generated in an ink supply system made of the ink supply tube 16 and the ink storage section 20, at the time of scanning of the carriage 2. As a result, it is possible to reduce an adverse effect on jetting of the recording head 3.

On an inner side of a portion near the other end of each of the air discharge passages 21, an air discharge valve 22 for opening and closing the air discharge passage 21 is provided. At an intermediate portion of the air discharge passage 21, an air discharge port 23 having a diameter which is smaller than inner diameter of the air discharge passage 21 is provided. The air discharge valve 22 ascends and descends between a position closing the air discharge port 23 and a position opening the air discharge port 23.

In a normal condition such as at the time of recording, as shown in FIG. 3, the air discharge passage 21 is biased, by an elastic body 24 in the form of a spring (spring elastic body 24) arranged inside, toward the air discharge valve 22 in a downward direction, in other words, toward a side closing the air discharge port 23. A rod 25 extending toward an outer side of the air discharge port 23, in other words, in a direction in which the bias is applied by the spring elastic body 24, is provided integrally to the air discharge valve 22. By pushing up the rod 25 by a valve opening and closing mechanism 26 which will be described later, the air discharge valve 22 opens the air discharge port 23 of the air discharge passage 21.

The maintenance unit 13, as shown in FIG. 2, includes a first cap body 30 which is capable of covering the nozzle formation surface 7 such that the nozzle rows of the recording head 3 are surrounded, and a second cap body 31 which is capable of covering collectively the lower ends 21*b* of the four air discharge passages 21. Both the first cap body 30 and the second cap body 31 are in the form of a box having an upper surface open, and are made of rubber-like elastic body, and are mounted in line on a cap body holder 32. The cap body holder 32 is capable of ascending and descending by an ascending and descending mechanism 33. At an ascended position, the first cap body 30 makes a close contact with the nozzle formation surface 7 while being elastically deformed, and simultaneously, the second cap body 31 makes a close contact with the lower end of the air discharge passages 21 while being elastically deformed.

Both the first cap body 30 and the second cap body 31 are connected to a pump 34 via a discharge path 43. A first discharge port 35 communicating with the pump 34 is formed in a bottom wall of the first cap body 30, and a second discharge port 36 communicating with the pump 34 is formed in a bottom wall of the second cap body 31 (refer to FIG. 3).

The discharge path 43 extends from the pump 34 branching to the first discharge port 35 and the second discharge port 36, and a selector valve 37 is arranged at a branching point. By switching the selector vale 37, it is possible to switch to one of a state in which each of the first discharge port 35 and the second discharge port 36 is connected separately to the pump 34, a state in which both the first discharge port 35 and the second discharge port 36 are connected simultaneously to the pump 34, and a state in which none of the first discharge port 35 and the second discharge port 36 are connected to the pump 34.

On an inner side of the second cap body 31, projections 38 are formed. Each of the projections 38 corresponds to a position of the rod 25 provided for one of the four air discharge passages 21. When each of the projections 38 is ascended along with the second cap body 31 by the ascending and descending mechanism 33, the projection 38 makes a contact with the rod 25 and pushes the rod 25 up, thereby opening the air discharge port 23. Consequently, the valve opening and closing mechanism 26 includes mainly the projections 38, the ascending and descending mechanism 33, and the like. Moreover, an air discharge mechanism in claims, includes here, the air discharge passages 21 each of which has the one end 21*a* connected to the ink storage section 20, and the other end 21*b* covered by the second cap body 31, the air discharge valve 22 which is provided to each of the air discharge passages 21, the valve opening and closing mechanism 26 which opens and closes the air discharge valve 22, and the pump 34 which sucks the air accumulated in the ink storage section 20 via the second cap body 31 and the air discharge passages 21.

The maintenance unit 13 further includes a wiper 39 which wipes the nozzle formation surface 7, such that the wiper 39 moves up and down by the ascending and descending mechanism 40. When the recording head 3 returns to a recording area, the wiper 39 moves up and wipes the nozzle formation surface 7.

Each of operations namely, a rotational drive of the pump 34, up and down movement of the ascending and descending mechanisms 33 and 40, and a switching of the selector valve 37 included in the maintenance unit 13 is carried out by an independent drive source. Or, it is also possible to drive each mechanism of the entire maintenance unit 13 according to a movement of a cam one by one, by one drive source. Moreover, an arrangement may be made such that a driving force is transmitted selectively to the maintenance unit 13 and transporting rollers 42, by using a paper transporting (LF) motor 41 (refer to FIG. 4), and switching a direction of rotation of the LF motor 41.

A recovery operation in the maintenance unit 13 structured in such manner will be described below. When the recording head 3 moves to a maintenance position by a movement of the carriage 2, the cap body holder 32 moves up, and the first cap body 30 covers the nozzle formation surface 7. At the same time, the second cap body 31 covers the lower end of the air discharge passage 21 (hereinafter, described as cap covering state), and the projection 38 makes a contact with the rod 25 of the air discharge valve 22 and opens the air discharge port 23.

In the cap covering state, the selector valve 37 is switched such that the pump 34 communicates only with the first cap body 30, and the suction by the pump 34 is started. In this case, thickened ink and air are discharged outside along with the ink in the recording head 3, from the nozzles (not shown in the diagram). In the following description, this operation is called as a suction purge.

On the other hand, in the cap covering state described above, the selector valve 37 is switched such that the pump 34 communicates only with the second cap body 32, and the suction by the pump 34 is started. In this case, air accumulated in the ink storage section 20 is discharged outside through the air discharge passages 21 along with some ink. In the following description, this operation is called as an air discharge operation.

After the suction purge operation or the air discharge operation described above are over, the cap body holder 32 descends, and the first cap body 30 is separated from the nozzle formation surface 7, and the second cap body 31 is separated from the lower end of the air discharge passage 21. In the state of being separated, the selector valve 37 is switched such that the pump 34 communicates with one or both of the first cap body 30 and the second cap body 31, and the suction by the pump 34 is started. In this case, the ink remained in each of the first cap body 30 and the second cap body 31 is discharged.

Furthermore, when the recording head 3 returns from the maintenance position to the recording area, the wiper 39 is moved up, by the ascending and descending mechanism 40, to a position at which the wiper 39 contacts with the nozzle formation surface 7. Moreover, by the movement of the recording head 3, the nozzle formation surface 7 is wiped relatively by the wiper 39, and the ink and paper dust adhered to the nozzle formation surface 7 is removed. In the following description, this operation is called as a wiping operation.

In a case of carrying out the suction purge operation and the air discharge operation successively, the air discharge operation is carried out first, and with the amount of air in the ink storage section 20 reduced, the suction purge operation is carried out. It is also possible to carry out separately the suction purge operation and the air discharge operation. The wiping operation is carried out without fail after the suction purge operation is carried out.

Figure 4:
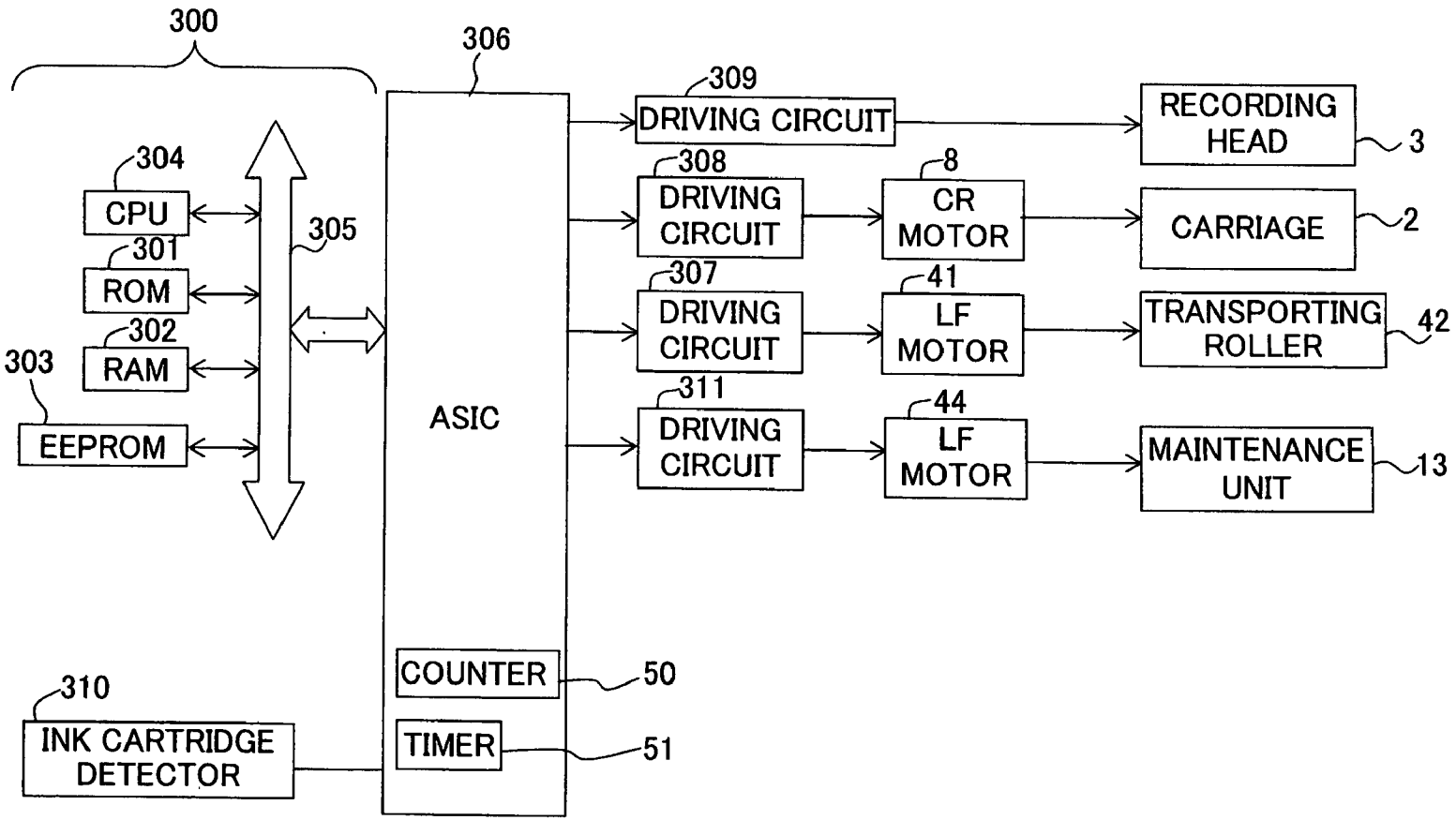
FIG. 4 is a block diagram showing a controller.
Figure 5:
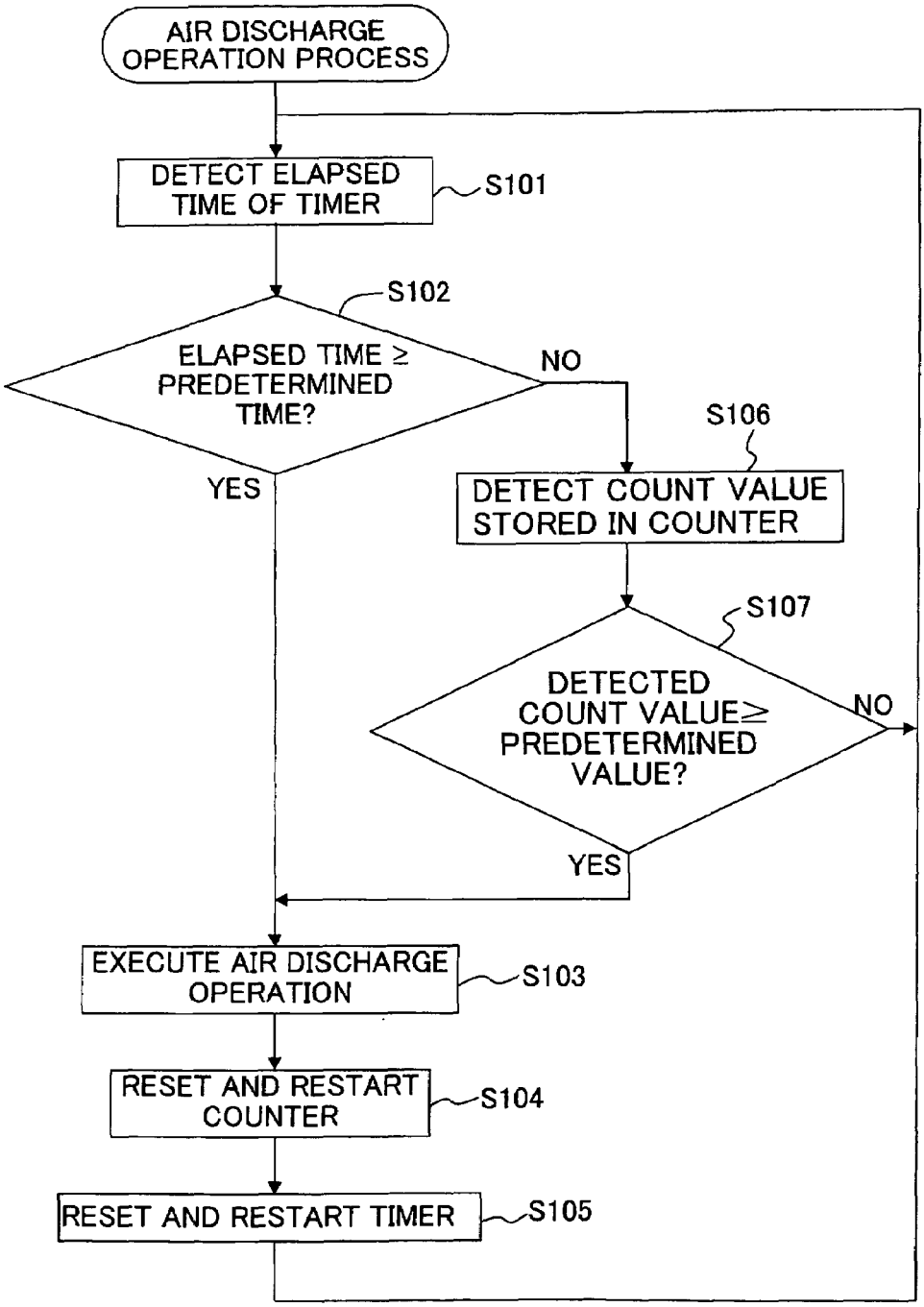
FIG. 5 is a flow chart of an air discharge operation.

Next, the controller 300 which controls the entire operation of the recording apparatus 1 will be described by referring to FIG. 4. The controller 300 includes mainly a microcomputer which includes a CPU (Central Processing Unit) 304, a ROM (Read Only Memory) 301, a RAM (Random Access Memory 302, and an EEPROM (Electrically Erasable and Programmable Read Only Memory) 303, and an ASIC (Application Specific Integrated Circuit) 306 which is connected to the CPU 304, the ROM 301, the RAM 302, and the EEPROM 303, via a bus 305. The counter 50 which stores a frequency of detaching and attaching the ink cartridges 14 after the previous air discharge operation is carried out and a timer 51 which measures an elapsed time elapsed after the previous air discharge operation is carried out are built-in inside the ASIC 306 or the microcomputer. The frequency stored in the counter 50 and the elapsed time measured by the timer 51 are not lost by putting OFF a power supply of the recording apparatus 1.

Computer programs etc. which control various operations of the recording apparatus 1 are stored in the ROM 301, and the RAM 302 is used as a working area and as a storage area which stores temporarily various data to be used when the CPU 304 executes these computer programs.

Moreover, the ASIC 306 follows a command from the microcomputer and generates phase excitation signals to be applied, for example, to various motors. Further, the ASIC 306 imparts (applies) these phase excitation signals to a driving circuit 307 of the paper transporting (LF) motor 41, a driving circuit 308 of the carriage (CR) motor 8, and a driving circuit 311 of a drive source (LF motor) 44 for the maintenance unit 13, and controls the transporting rollers 42, the carriage 2, and the maintenance unit 13.

A driving circuit 309 is a circuit for causing the recording head 3 to jet the ink selectively onto a paper at a predetermined timing, and controls the recording head 3 by receiving a signal output from the ASIC 306, based on recording data.

Furthermore, the ink cartridge detector 310 which detects that the ink cartridge 14 has been attached and detached is connected to the ASIC 306.

A table for determining a timing of executing the air discharge operation is stored in the ROM 301. A predetermined time (for example 20 days) for periodically carrying out the air discharge operation is set in this table. Moreover, executing the air discharge operation when the elapsed time which is measured by the timer 51 is not less than the predetermined time, and executing the air discharge operation on priority basis when the number of times of attaching and detaching of the ink cartridges 14 (count value) stored in the counter 50 is not less than a predetermined value (for example 20 times) and the elapsed time which is measured by the timer 51 is less than the predetermined time, have been stored (in this table). The predetermined time and the predetermined value stored in this table are determined appropriately according to a material and a volume etc. of the ink supply system.

A flow chart related to the air discharge operation of the recording apparatus 1 structured in such manner will be described below. Firstly, in the recording apparatus 1, when the recording apparatus 1 is switched on, when a recording instruction is given, or periodically during the recording operation, the elapsed time measured by the timer 51 is detected (step S101), and the elapsed time which is detected and the predetermined time stored in the ROM 31 are compared (step S102). Moreover, when the elapsed time is not less than the predetermined time (Yes at step S102), the air discharge operation is executed (step S103). In other words, as the air discharge operation in the maintenance unit 13 described above, the recording head 3 is moved by the carriage 2 to a maintenance position, and as it has been described above, the air accumulated in the ink storage section 20 is discharged.

When the air discharge operation is over, the counter 50 is reset and restarted (step S104), and the timer 51 as well is reset and restarted (step S105).

On the other hand, when the elapsed time is less than the predetermined time (No at step S102), the count value which is stored in the counter 50 is detected (step S106), and the detected count value and the predetermined value stored in the ROM 301 are compared (step S107). When the detected cont value is not less than the predetermined value (Yes at step S107), the air discharge operation is carried out (step S103). After the completion of the air discharge operation, the counter 50 and the timer 51 are reset and restarted similarly as it has been described above (steps S104 and S105). When the detected value is less than the predetermined value (No at step S107), detection of the elapsed time measured by the timer 50 again is awaited.

Normally, air which gradually enters through the tube wall of the ink supply tube 16 which is flexible, and air which enters from a detachment portion when a normal user replaces the ink cartridge 14 (for example less than 20 times in 20 days) is accumulated in the ink storage section 20. However, according to the abovementioned structure, the ink storage section 20 is set to a volume which is still capable of a sufficient ink supply to the recording head 3, in spite of the presence of that much amount of air. Consequently, it is possible to maintain sufficiently the jetting condition of the recording head 3 to be favorable, by periodic (for example once in 20 days) air discharge operation.

However, in a case of a heavy user, the consumption of ink might be very high, and the ink cartridges 14 might be replaced frequently. Or, the ink cartridges 14 might be detached and attached repeatedly for the multiple number of times, for checking the recording apparatus 1. In such cases, a substantial amount of air beyond expectation entering into the ink at the time of detaching and attaching the ink cartridge 14 is accumulated, and may surpass a limit of causing a jetting defect of ink. Consequently, as it has been described above, by carrying out the air discharge operation also taking into consideration the number of times for which the ink cartridges 14 are detached and attached, in addition to the periodic air discharge operation, it is possible to facilitate more assuredly a stabilization of the jetting condition of the recording head 3.

In the embodiment which has been described above, by switching the selector valve 37, it has been possible to switch a state in which each of the first discharge port 35 and the second discharge port 36 is connected separately to the pump 34, a state in which both the first discharge port 35 and the second discharge 36 are connected simultaneously to the pump 34, and a state in which none of the first discharge port 35 and the second discharge port 36 are connected to the pump 34. However, such an arrangement is a mere example, and a separate pump may be connected to each of the first discharge port 35 and the second discharge port 36. In this case, the selector valve 37 is unnecessary.

In the embodiment which has been described above, although each of the ink cartridge detectors 310 detects both attaching and detaching of the ink cartridge 14 to and from the ink receiving section 17, the ink cartridge detector 310 may detect either attaching or detaching of the ink cartridge 14.

Moreover, in the embodiment which has been described above, when the ink cartridge detector 310 detects that the ink cartridges 14 have been detached from and attached to the ink receiving sections 17 of the recording apparatus 1, the controller 300 increments the number of times of attachment and detachment of the ink cartridges 14 (count value) stored in the counter 50. When the count value stored in the counter 50 surpasses the predetermined value stored in the ROM 31, the air discharge operation is executed. However, such an arrangement is a mere example, and it is also possible to have a similar effect by having an arrangement such that a predetermined value is stored in advance in the counter 50, and whenever the ink cartridge detector 310 detects that the ink cartridges 14 have been detached from and attached to the ink receiving sections 17 of the recording apparatus 1, the controller reduces the value stored in the counter 50 by one, and carries out the air discharge operation when the frequency stored in the counter 50 becomes 0.

Moreover, in the embodiment which has been described above, the controller 300 may further include a timer 51' which measures a time for which the ink cartridge 14 had been removed from the recording apparatus 1. The time measured by the timer 51' may be detected at a point of time when the ink cartridge detector 310 has detected that one of the ink cartridges 14 is fixed to the recording apparatus 1, and when the time measured by the timer 51' surpasses a predetermined time, the value stored in the counter 10 may be increased. In this case, by storing, in the counter 50, the time for which the ink cartridges 14 had been removed from the recording apparatus 1 upon converting to the number of times of detaching and attaching of the ink cartridges 14, the controller 300 is capable of making a judgment of whether or not it is necessary to carry out the air discharge operation, upon taking the length of time for which the ink cartridge 14 had been removed from the recording apparatus 1 into account.

Since the present invention is applicable over a wide range to a recording apparatus which includes a replaceable ink cartridge, it is also applicable to a recording apparatus such as a line printer in which the recording head does not move with the carriage.

Moreover, the present invention is not restricted to a recording apparatus which has only a printer function, and is also applicable to a multi-function recording apparatus which is provided with a plurality of functions such as a facsimile function and a copy function.

What is claimed is:

1. A recording apparatus which records an image on a recording medium with an ink, the recording apparatus comprising:

an ink cartridge which is detachably fixed to the recording apparatus and stores the ink;

a recording head which records the image by jetting the ink stored in the ink cartridge onto the recording medium;

an ink tank which stores the ink supplied from the ink cartridge and which supplies the ink to the recording head;

an air discharge mechanism which discharges air accumulated in the ink tank;

a controller which controls the air discharge mechanism to discharge the air accumulated in the ink tank at a predetermined time interval; and a counter which counts attachment-detachment number of times of the ink cartridge performed after the air discharge mechanism previously discharged the air accumulated in the ink tank, wherein if the attachment-detachment number of times counted by the counter is not less than a predetermined value in the predetermined time interval, the controller controls the air discharge mechanism to discharge the air accumulated in the ink tank.

2. The recording apparatus according to claim 1, further comprising an ink supply tube which connects the ink cartridge and the ink tank, wherein the ink is supplied from the ink cartridge to the ink tank, via the ink supply tube.

3. The recording apparatus according to claim 1, further comprising an ink cartridge detector which detects that the ink cartridge is detached from and attached to the recording apparatus.

4. The recording apparatus according to claim 3, wherein the counter stores the attachment-detachment number of times; and the controller increments the attachment-detachment number of times stored in the counter when the ink cartridge detector detects that the ink cartridge has been detached from the recording apparatus and when the ink cartridge detector detects that the ink cartridge has been attached to the recording apparatus.

5. The recording apparatus according to claim 1, further comprising a cap, wherein the air discharge mechanism includes an air discharge passage having one end which is connected to the ink tank and having the other end which is covered by the cap, an air discharge valve which is provided on the air discharge passage, a valve opening and closing mechanism which opens and closes the air discharge valve, and a pump which sucks the air accumulated in the ink tank via the cap and the air discharge passage.

6. The recording apparatus according to claim 5, wherein the one end of the air discharge passage protrudes from an inner surface of the ink tank toward an inner side of the ink tank.

7. The recording apparatus according to claim 6, wherein an air discharge port having a diameter smaller than an inner diameter of the air discharge passage is formed in the air discharge passage at an intermediate portion thereof; and the air discharge valve is biased in a bias direction to close the air discharge port by an elastic body.

8. The recording apparatus according to claim 7, wherein the air discharge valve includes a rod which extends in the bias direction; and the valve opening and closing mechanism opens the air discharge valve by moving the rod in a direction opposite to the bias direction.

9. The recording apparatus according to claim 1, wherein the controller further includes a timer which measures a time during which the ink cartridge has been detached from the recording apparatus; and when the time measured by the timer surpasses a predetermined time, the controller increments the attachment-detachment number of times stored in the counter.

10. The recording apparatus according to claim 1, further comprising a carriage which is movable with respect to a body of the recording apparatus, wherein the recording head and the ink tank are provided on the carriage; and after the air discharge mechanism has discharged the air accumulated in the ink tank, a predetermined amount of air remains in the ink tank.

11. The recording apparatus according to claim 2, further comprising a carriage which is movable with respect to a body of the recording apparatus, wherein the recording head and the ink tank are provided to the carriage; and the ink supply tube is flexible.

12. A maintenance method for a recording apparatus including an ink cartridge which stores an ink and which is detachably fixed to the apparatus, a recording head which jets the ink stored in the ink cartridge, and an ink tank which stores the ink supplied from the ink cartridge and supplies the ink to the recording head, the method comprising:

discharging air accumulated in the ink tank;

measuring an elapsed time elapsed after the air has been discharged;

storing attachment-detachment number of times of the ink cartridge from and to the recording apparatus performed after the air accumulated in the ink tank has been discharged;

detecting the elapsed time elapsed after the air has been discharged;

comparing the elapsed time with a predetermined time;

detecting the attachment-detachment number of times stored in the counter, when the elapsed time is not more than the predetermined time;

comparing the detected attachment-detachment number of times with a predetermined value; and discharging air accumulated in the ink tank if the detected attachment-detachment number of times is not less than the predetermined value.

13. The maintenance method for the recording apparatus according to claim 12, wherein when an instruction for a recording operation is given to the recording apparatus, the elapsed time is detected.

14. The maintenance method for the recording apparatus according to claim 12, wherein when the recording apparatus is switched on, the elapsed time is detected.

* * * * *